US006670871B1

(12) United States Patent
Saso et al.

(10) Patent No.: US 6,670,871 B1
(45) Date of Patent: Dec. 30, 2003

(54) POLAR RELAY

(75) Inventors: Hirofumi Saso, Tokyo (JP); Noboru Fujii, Tokyo (JP)

(73) Assignee: Takamisawa Electric Co., Ltd., Tokyo (JP)

( * ) Notice: Subject to any disclaimer, the term of this patent is extended or adjusted under 35 U.S.C. 154(b) by 167 days.

(21) Appl. No.: 09/926,061

(22) PCT Filed: Nov. 20, 2000

(86) PCT No.: PCT/JP00/08179

§ 371 (c)(1),
(2), (4) Date: Aug. 22, 2001

(87) PCT Pub. No.: WO01/48778

PCT Pub. Date: Jul. 5, 2001

(30) Foreign Application Priority Data

Dec. 24, 1999 (JP) ..... 11/368070

(51) Int. Cl.[7] ..... H01H 51/22
(52) U.S. Cl. ..... 335/78; 335/80; 335/128
(58) Field of Search ..... 335/78–86, 124, 335/128–9, 130–131

(56) References Cited

U.S. PATENT DOCUMENTS 4,703,293 A * 10/1987 Ono et al. ..... 335/78
5,153,543 A * 10/1992 Hitachi et al. ..... 335/78

FOREIGN PATENT DOCUMENTS

| | | |
|---|---|---|
| JP | 4-253132 | 9/1992 |
| JP | 5-27944 | 4/1993 |
| JP | 5-41049 | 6/1993 |
| JP | 5-79851 | 10/1993 |
| JP | 5-314885 | 11/1993 |
| JP | 6-111700 | 4/1994 |
| JP | 7-335108 | 12/1995 |
| JP | 8-111158 | 4/1996 |
| JP | 9-320431 | 12/1997 |
| JP | 11-260231 | 9/1999 |
| JP | 2000-222990 | 8/2000 |

* cited by examiner

*Primary Examiner*—Lincoln Donovan
(74) *Attorney, Agent, or Firm*—Armstrong, Kratz, Quintos, Hanson & Brooks, LLP

(57) ABSTRACT

A balanced-armature type polar relay (10) capable of assuring, by its own structure, sufficient insulation distances, meeting the requirements of IEC60950, when mounted on an electric communication line connecting equipment, wherein a maximum distance between one movable contact and one fixed contact capable of being brought into contact with each other during the travel of an armature is set at 1 mm or more, and at least one of the abutting surfaces of the armature and the core polar surfaces of the electromagnet opposed to the abutting surfaces is formed as an inclined surface to reduce an angle of opposed surfaces at the time of mutual abutment to as little as possible, whereby the armature passes, during the travel thereof, a position where each of the pair of abutting surfaces faces the pair of corresponding core polar surfaces in parallel with each other.

14 Claims, 15 Drawing Sheets

POLAR RELAY

CROSS REFERENCE TO RELATED APPLICATIONS

This application is a 371 of PCT/JP00/08179.

TECHNICAL FIELD

The present invention relates to a polar (or polarized) relay, and more particularly to a polar relay of a balanced-armature type. Also, the present invention relates to an information processing apparatus provided with a balanced-armature type polar (or polarized) relay. The present invention further relates to a method of manufacturing a balanced-armature type polar relay.

BACKGROUND ART

A polar relay that is comprised of a base, an electromagnet incorporated into the base, a permanent magnet provided in conjunction with the electromagnet, an armature supported pivotably on the base, the armature having a pair of abutting surfaces in opposite end regions at a distance from the pivoting center of the armature, which are opposed to and capable of abutting on a pair of core polar surfaces of the electromagnet, at least one electrically conductive plate spring pivotable on the base along with the armature, movable contacts provided on the opposite ends of each of at least one conductive plate spring, and a plurality of fixed contacts disposed securely on the base so as to be respectively opposed to and capable of coming into contact with the corresponding movable contacts, is known as a balanced-armature type polar relay. Generally, this type of polar relay has advantages of higher sensitivity, shorter operating time, etc., in comparison with a non-polarized relay, as well as being easy to reduce in size and power consumption, so that, in recent years, they have been increasingly utilized in various information processing apparatuses, such as modems and facsimiles in offices and homes, which are adapted to be connected to telecommunications channels or electric communication lines.

When telecommunications-channel connectable equipment are to be connected to a telecommunications channel (e.g., a telephone circuit), it is required that circuits (a power circuit, a signal circuit) of the connectable equipment are isolated from the telecommunications channel with sufficient dimensions for insulation (i.e., sufficient insulation distances), as prescribed, for respective utilized voltages, in the international standard IEC60950. Conventionally, in order to assure such insulation distances as prescribed, certain measures have been taken, wherein a non-polarized relay having a relatively large open- or break-contact distance (that is, a maximum distance between contacts during the travel of an armature) is adopted as a relay to be mounted in the telecommunications-channel connectable equipment, or wherein a transformer is interposed between the circuit of the connectable equipment and the telecommunications channel.

The above described conventional measures for insulation meeting the requirements of IEC60950 have some problems to be solved, from the viewpoint of reduction in size and in power consumption. First, in the case of mounting a non-polarized relay in the connectable equipment, the non-polarized relay has a long armature travel and thus the finished product has relatively large external dimensions, which may become factors inhibiting the reduction in size and power consumption of the connectable equipment. On the other hand, when a low power-consumption polar relay, as described above, is mounted in the telecommunications-channel connectable equipment, the polar relay has, in general, a relatively small open- or break-contact distance, which would require the provision of a transformer, mounted in the connectable equipment, to be interposed between a circuit of the connectable equipment and the telecommunications channel, so as to meet the requirements of IEC60950. Thus, in this case, even when a sufficiently small polar relay is used, the existence of the transformer may resultingly hamper the size reduction of the telecommunications-channel connectable equipment.

Further, in order to meet the requirements of IEC60950, it is desired for a relay to be mounted in telecommunications-channel connectable equipment such that sufficient insulation distances are assured not only between contacts in an opened state but also between, for example, a contact and a coil of an electromagnet, or between contacts arranged side-by-side in the case of a double-circuit type relay. Especially, in a miniature polar relay, it has been a problem to assure the insulation distances between various above-described components.

DISCLOSURE OF THE INVENTION

It is an object of the present invention to provide a polar relay, of a balanced-armature type, that is capable of assuring, by its own structure, sufficient insulation distances, meeting the requirements of IEC60950, when it is mounted in telecommunications-channel connectable equipment.

It is another object of the present invention to provide a polar relay, of a balanced-armature type, that is capable of increasing insulation distances required between contacts in an opened state, while the external dimensions of the finished product are prevented from increasing as effectively as possible.

It is still another object of the present invention to provide a polar relay, of a balanced-armature type, that is capable of assuring sufficient insulation distances required between a contact and a coil, while the external dimensions of the finished product are prevented from increasing as effectively as possible.

It is still another object of the present invention to provide a polar relay, of a balanced-armature type, that is capable of assuring sufficient insulation distances required between contacts arranged side-byside, while the external dimensions of the finished product are prevented from increasing as effectively as possible.

It is still another object of the present invention to provide a miniature information processing apparatus, of a low power-consumption type, that is capable of assuring sufficient insulation distances meeting the requirements of IEC60950, when it is connected to a telecommunications channel.

It is still another object of the present invention to provide a method for manufacturing a polar relay that 15 is capable of assuring, by its own structure, sufficient insulation distances, meeting the requirements of IEC60950, when it is mounted in telecommunications-channel connectable equipment.

In order to accomplish the above objects, the present invention provides a polar relay comprising a base; an electromagnet incorporated into the base; a permanent magnet provided in conjunction with the electromagnet; an armature pivotably supported on the base and having a pair of abutting surfaces disposed in opposite end regions at a distance from a pivoting center, which are respectively opposed to and capable of abutting on a pair of core polar surfaces of the electromagnet; at least one electrical conductive plate spring pivotable on the base along with the armature; a plurality of movable contacts provided on opposite ends of each of the at least one electrical conductive plate spring; and a plurality of fixed contacts arranged securely on the base, the fixed contacts being respectively opposed to and capable of coming into contact with the movable contacts; wherein the maximum distance between one of the movable contacts and one of the fixed contacts, capable of coming into contact with each other during the travel of the armature, is set to 1 mm or more.

In the preferred aspect, the polar relay is constituted such that at least one of each of the pair of abutting surfaces of the armature and each of the pair of core polar surfaces of the electromagnet, opposed to the abutting surface, is formed as an inclined surface for reducing an angle between opposed surfaces, during a mutual abutment, as much as possible, and that the armature passes, during the travel thereof, a position where each of the pair of abutting surfaces oppositely faces a corresponding one of the pair of core polar surfaces in parallel with each other.

In this arrangement, the thickness of the opposite end regions in a pivoting direction of the armature may gradually decrease toward opposite ends of the armature, the pair of abutting surfaces being thereby formed as the inclined surfaces.

In this case, it is advantageous that a non-magnetic layer is formed on one of the abutting surfaces of the armature which is arranged on a make side.

It is also preferred that the thickness of the non-magnetic layer is uniform.

The permanent magnet may be fixedly connected to the armature in a position deviated toward a break side.

In another preferred aspect, comprising at least two electrically conductive plate springs, the polar relay further comprises an insulating member integrally connecting the armature with the at least two electrically conductive plate springs so as to be spaced in a lateral direction perpendicular to a pivoting direction of the armature and arranged side-by-side while at least the abutting surfaces and the movable contacts are exposed, wherein the insulating member covers most of an intermediate portion of the armature located between the opposite end regions, and wherein the at least two electrically conductive plate springs are disposed so as to define, at proximal end portions thereof projecting from the insulating member, a lateral distance from the insulating member, smaller than a lateral distance between the movable contacts and the abutting surfaces.

In this arrangement, the polar relay may be provided, wherein the thickness of the opposite end regions in the pivoting direction of the armature gradually decreases toward opposite ends of the armature, and wherein a dimension of the opposite end regions in a lateral direction of the armature, perpendicular to the pivoting direction, is larger than a dimension of the intermediate region in the lateral direction.

In a further preferred aspect, the polar relay is provided wherein the electromagnet includes a core, an insulating bobbin attached to the core with the pair of core polar surfaces exposed, and a coil wound on the insulating bobbin, wherein the base includes an insulating upper plate interposed between the armature and the coil and cooperating with the insulating bobbin to increase dimensions for insulation, required between the pair of core polar surfaces and the coil, and wherein the insulating bobbin and the insulating upper plate are provided with combined portions to be complementarily combined with each other at a location between the pair of core polar surfaces and the coil.

In this arrangement, it is advantageous that the core includes, near the pair of core polar surfaces, overhang portions projecting from a surface of the insulating bobbin, and that the insulating bobbin covers the core except for the pair of core polar surfaces as well as regions including the overhang portions and surrounding the core polar surfaces.

Also, the base may include an insulating bottom plate cooperating with the insulating upper plate to increase dimensions for insulation, required between a plurality of terminals respectively having the fixed contacts thereon and the coil, and the insulating upper plate and the insulating bottom plate may be complementarily combined with each other at a location between the terminals and the coil.

In this case, it is preferred that a sealant is applied to the complementarily combined portions of the insulating upper plate and the insulating bottom plate for sealing any gap between the combined portions.

In a further preferred aspect, the polar relay includes an insulating surface zone provided between the pair of core polar surfaces of the electromagnet and the plurality of fixed contacts so as not to expose the surfaces to each of the fixed contacts.

The polar relay according to the present invention is effectively usable, especially, for assuring dimensions for insulation, required between circuits as prescribed in IEC60950 regarding an information processing apparatus connectable to a telecommunications channel.

The present invention further provides an information processing apparatus connectable to a telecommunications channel, wherein a polar relay, as described above, is arranged between an inner circuit of the information processing apparatus and a telecommunications channel to assure dimensions for insulation, required between circuits.

The present invention further provides a method for manufacturing a polar relay, as described above, comprising providing a magnetic plate including a flat first surface, and a second surface having a major flat-face portion parallel to the first surface and an inclined-face portion crossing at an obtuse angle with the major flat-face portion and extending in a direction approaching the first surface; forming a non-magnetic layer having a uniform thickness on the first surface of the magnetic plate in a region located opposite to the inclined-face portion; opposing the second surface of the magnetic plate to a flat supporting plane, and securely placing the magnetic plate on the supporting plane; pressing a region of the first surface including the non-magnetic layer, to deform the magnetic plate while maintaining the uniform thickness of the non-magnetic layer until a surface of the non-magnetic layer exhibits a mirror image shape of the inclined-face portion provided in the second surface and the inclined-face portion shifts to a plane common to the major flat-face portion; and forming, from the magnetic plate, the armature including a region of the non-magnetic layer arranged on either one of the pair of abutting surfaces.

BRIEF DESCRIPTION OF THE DRAWINGS

The above and other objects, features and advantages of the present invention will become more apparent from the following description of preferred embodiments in connection with the accompanying drawings, in which.

BEST MODES FOR CARRYING OUT THE INVENTION

Figure 1:
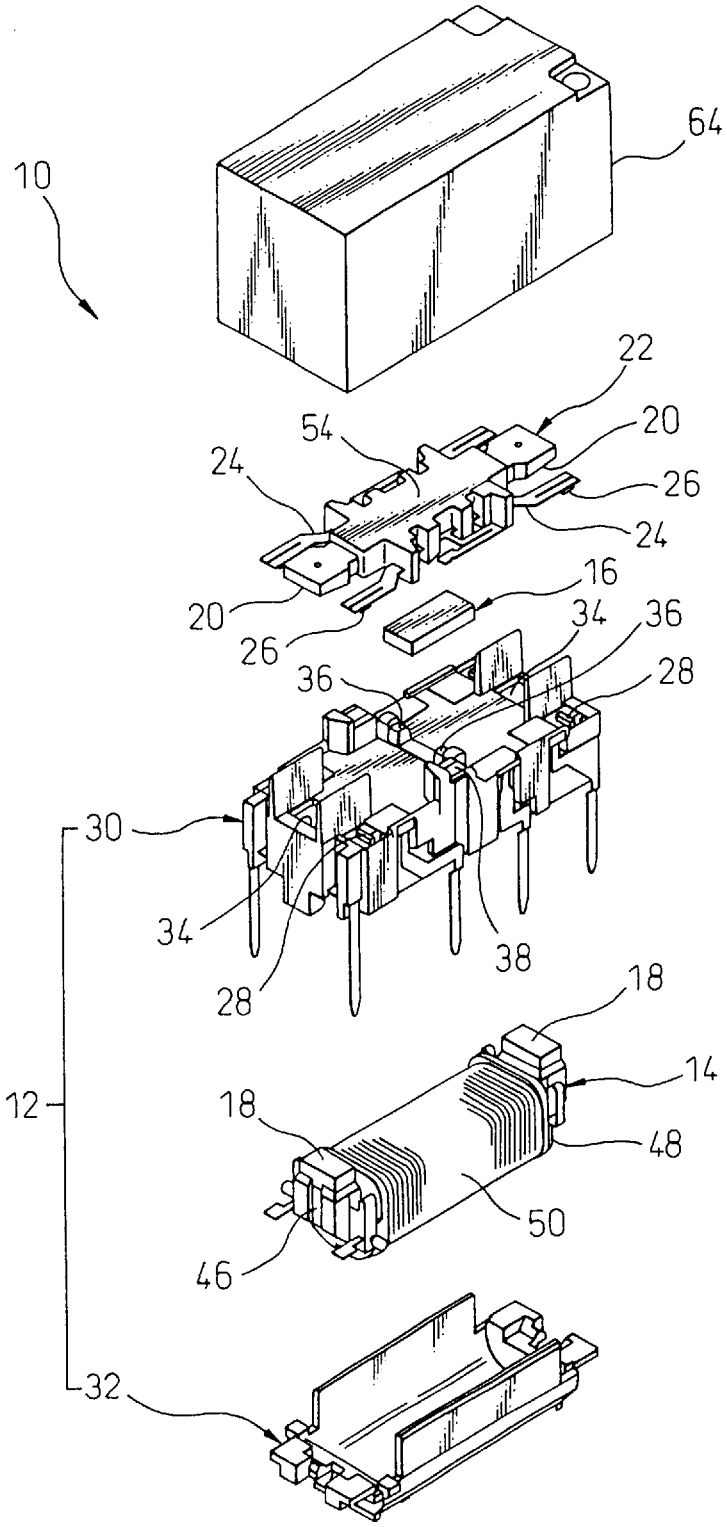
FIG. 1 is an exploded perspective view showing a polar relay according to an embodiment of the present invention.

The embodiments of the present invention will now be described in detail with reference to the accompanying drawings. Throughout the drawings, the same or similar components are denoted by common reference numerals.

Referring to the drawings, FIG. 1 shows a polar relay 10 according to an embodiment of the present invention. The polar relay 10 according to the illustrated embodiment has a balanced-armature construction of a small-size, low-power-consumption type, which can be used in an information processing apparatus, such as a modem or a facsimile, adapted to be connected to a telecommunications channel.

As shown in FIG. 1, the polar relay 10 includes a base 12, an electromagnet 14 incorporated into the base 12, a permanent magnet 16 provided in conjunction with the electromagnet 14, an armature 22 pivotably supported like a seesaw on the base 12, the armature having a pair of abutting surfaces 20 disposed in opposite end regions at a distance from the pivoting center of the armature, which are respectively opposed to and capable of abutting on a pair of core polar surfaces 18 of the electromagnet 14, two electrically conductive plate springs 24 pivotable on the base 12 along with the armature 22, movable contacts 26 provided on opposite ends of each of the conductive plate springs 24, and a plurality of fixed contacts 28 arranged securely on the base 12, the fixed contacts being respectively opposed to, and capable of coming into contact, with the movable contacts 26.

The base 12 includes an upper plate member 30 and a bottom plate member 32, each of which is an electrically insulating resinous mold, and which are combined with each other. The electromagnet 14 is securely contained in the internal space defined by the upper plate member 30 and the bottom plate member 32. The upper plate member 30 of the base 12 is a generally rectangular parallelepiped partial case for covering mainly the upper portion of the electromagnet 14. The upper plate member is provided in the longitudinal opposite end regions in the upper side thereof with a pair of openings 34 penetrating therethrough for receiving and exposing a pair of core polar surfaces 18 of the electromagnet 14, and in the center region of the upper side thereof with two supports 36 integrally protruding therefrom so as to provide a pivoting fulcrum for the armature 22. The bottom plate member 32 of the base 12 is a generally rectangular parallelepiped partial case for covering mainly the lower portion of the electromagnet 14.

Further, on the upper side of the upper plate member 30, a pair of fixed contacts 28 positioned at longitudinal opposite ends and one common contact 38 positioned generally at a midpoint between the fixed contacts 28, are provided to be aligned along each of the lateral edges extending in the longitudinal direction and are insulated from each other. As is clearly shown in FIG. 2, the fixed contacts 28 and the common contacts 38 are arranged symmetrically with respect to an upper-side center line 30*a* linking the openings 34 with each other, and thus constitute a make contact 28*a*, a break contact 28*b* and a common contact 38 on each side of the center line 30*a*. Therefore, the polar relay 10 has the structure of a dual-circuit relay.

Each fixed contact 28 and each common contact 38 are carried respectively on one end of a fixed terminal 40 and of a common terminal 42, the terminals being independent of each other. The fixed terminals 40 and the common terminals 42 are integrally and fixedly built in the upper plate member 30 by, e.g., being placed as inserts in a mold (not shown) during the molding of the upper plate member 30. Each fixed terminal 40 and each common terminal 42 are provided with legs 40*a*, 42*a* extending downward from each lateral side of the upper plate member 30. Further, a pair of coil terminals 44 connected with the coil of the electromagnet 14, as described later, is integrally and fixedly built in the upper plate member 30 by, e.g., an insert molding process. Each coil terminal 44 is provided with a leg 44*a* extending downward from the upper plate member 30. The legs 40*a*, 42*a* and 44*a* of the fixed terminal 40, common terminal 42 and coil terminal 44 are arranged substantially in parallel with each other.

Figure 3:
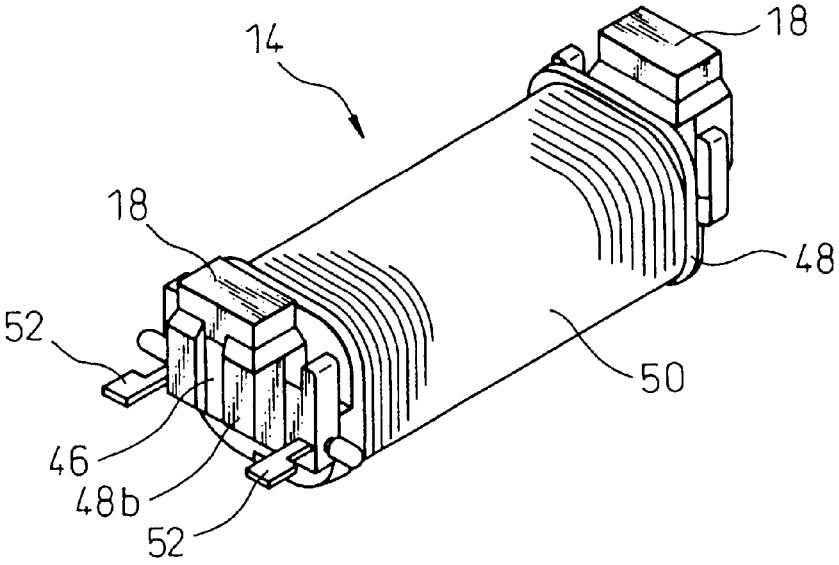
FIG. 3 is an enlarged perspective view showing an electromagnet in the polar relay of FIG. 1.
Figure 4:
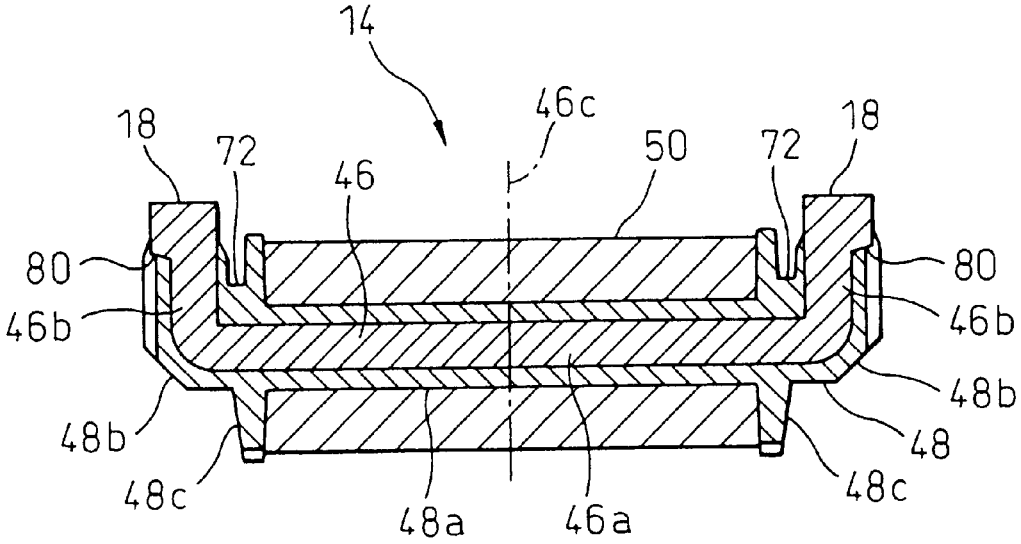
FIG. 4 is a vertical sectional view showing the electromagnet of FIG. 3.
Figure 5:
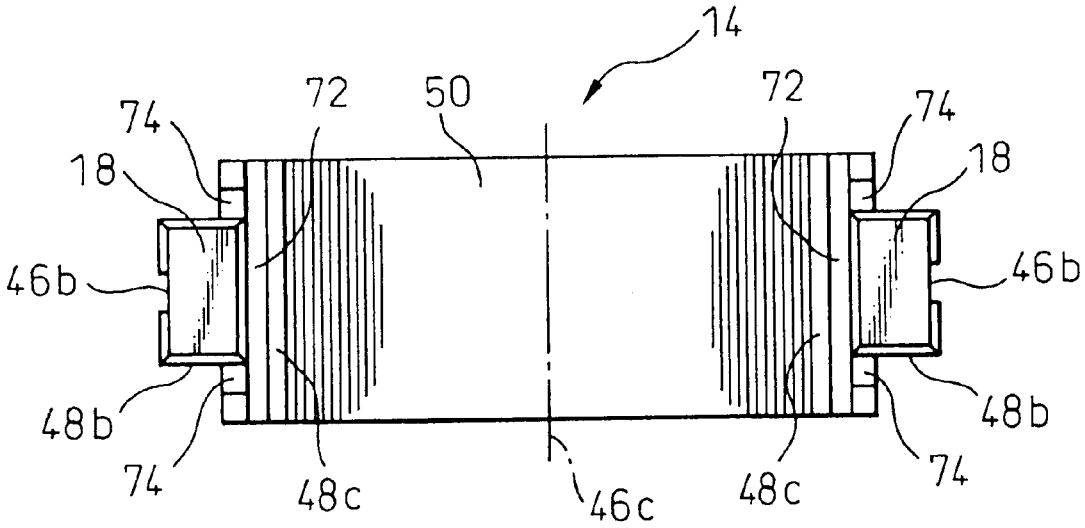
FIG. 5 is a plan view showing the electromagnet of FIG. 3.

The electromagnet 14 includes an iron core 46, a bobbin 48 attached to the core 46 so as to expose a pair of core polar surfaces 18, and a coil 50 wound on the bobbin 48. As shown in FIGS. 3 to 5, the core 46 includes a base portion 46*a* having a generally rectangular plate shape and a pair of arm portions 46*b* extending integrally from the longitudinal opposite ends of the base portion 46*a* in a direction generally perpendicular to the base portion 46*a*, with the core polar surfaces 18 being respectively formed on the end surfaces of the arm portions 46*b*. The core 46 may be formed by, e.g., punching a magnetic steel plate into a predetermined shape and thereafter bending the punched material into a U-shape.

The bobbin 48 is an electrical insulating resinous mold, and is integrally and fixedly attached to the core 46 by, e.g., placing the core 46 as an insert in a mold (not shown) during the molding of the bobbin. The bobbin 48 integrally includes an intermediate portion 48*a* for covering most of the base portion 46*a* of the core 46, a pair of end portions 48*b* for covering most of the arm portions 46b of the core 46, and a pair of flange portions 48c formed in interconnecting regions between the intermediate portion 48*a* and the end portions 48*b*. The coil 50 is wound on the intermediate portion 48*a* of the bobbin 48 in a symmetrical arrangement with respect to a center line 46*c* extending in a lateral direction of the core 46, and is securely held between the flange portions 48*c*. The arm portions 46*b* of the core 46 extend through the end portions 48*b* of the bobbin 48 to project upward therefrom, so that the pair of core polar surfaces 18 are arranged symmetrically, in a same virtual plane, with respect to the center line 46*c* of the core 46.

Further, a pair of terminals 52 (FIG. 3) connected with the coil 50 are integrally provided by, e.g., an insert molding process, in one end portion 48*b* of the bobbin 48. The terminals 52 are fixedly connected by, e.g., a welding process to the pair of coil terminals 44 built in the upper plate member 30, when the electromagnet 14 is accommodated in a space between the upper plate member 30 and the bottom plate member 32 of the base 12.

Figure 6:
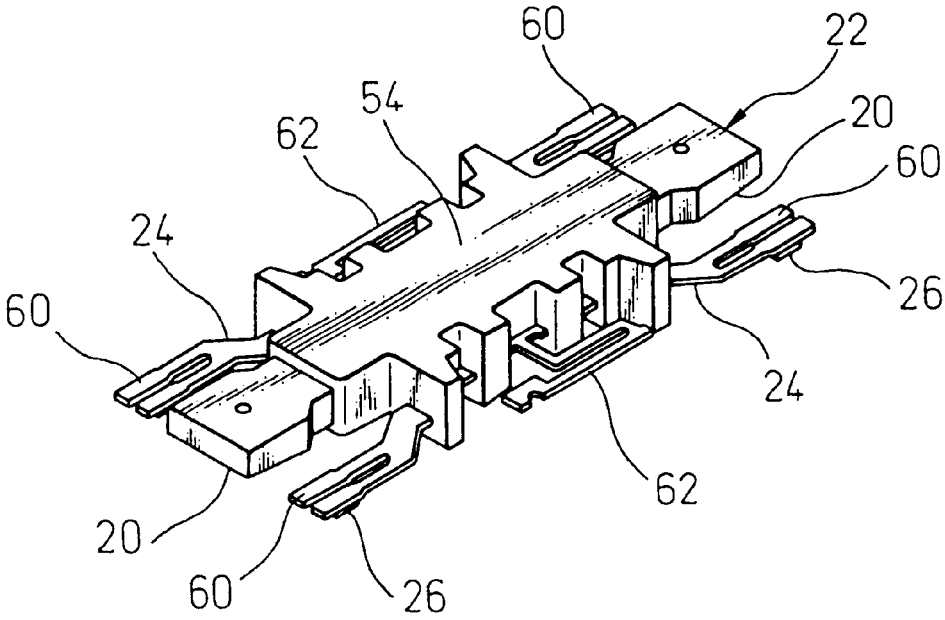
FIG. 6 is an enlarged perspective view showing an assembly of an armature and an electrically conductive plate spring in the polar relay of FIG. 1.
Figure 7:
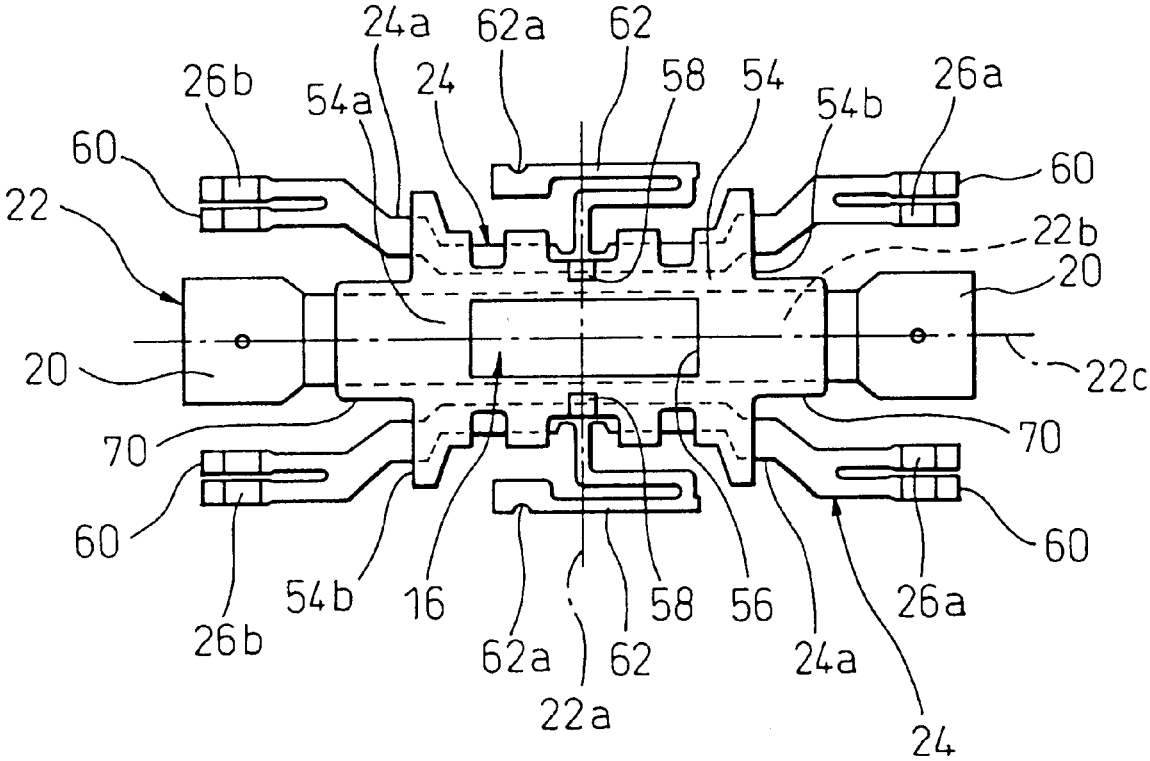
FIG. 7 is a plan view showing the assembly of FIG. 6.

The armature 22 is a flat plate-like member formed by, e.g., punching a magnetic steel plate into a predetermined shape, and is provided with the abutting surfaces 20 respectively formed in longitudinal opposite end regions in one surface of the armature (a lower surface in FIG. 1). As shown in FIGS. 6 and 7, the armature 22 has a symmetric shape with respect to a pivoting center 22*a* located at a longitudinal center of the armature, and is embedded at the intermediate region 22*b* defined between the abutting surfaces 20 into an insulating member 54 having likewise a symmetric shape. The armature 22 is integrally coupled to the two conductive plate springs 24, via the insulating member 54, in a mutually insulated condition.

The insulating member 54 is an electrically insulating resinous mold, and is integrally and fixedly attached to the armature 22 and the two conductive plate springs 24 by, e.g., placing the armature 22 and the conductive plate springs 24 as inserts in a mold (not shown) when molding the insulating member. A rectangular through hole 56 capable of receiving the permanent magnet 16 is formed in the insulating member 54 at the center of the bottom surface 54*a*thereof opposing the upper plate member 30 of the base 12. The permanent magnet 16 in the shape of generally rectangular plate is magnetized in the direction of thickness so as to provide different poles for the upper and lower faces thereof, and is securely fitted due to its own magnetic attractive force to the center portion of the armature 22 exposed inside the through hole 56 of the insulating member 54. The insulating member 54 is further provided, at the longitudinal center thereof on both lateral sides of the through hole 56, with a pair of seats 58 for respectively receiving a pair of supports 36 protruding on the upper plate member 30 of the base 12. Therefore, a line linking the seats 58 substantially coincides with the pivoting center 22*a* of the armature 22.

Although, in the illustrated embodiment, the permanent magnet 16 is constructed to pivot or rotate together with the armature 22 as described above, the present invention is not limited to this construction, and it is also possible to adopt the construction in which a permanent magnet is fixedly placed on the upper plate member 30 of the base 12. In this arrangement, the permanent magnet is magnetized in a longitudinal direction so as to provide the longitudinal center portion thereof with a pole different from the poles of the longitudinal opposite end portions located adjacent to the core polar surfaces 18.

Each conductive plate spring 24 is a thin plate member formed by, e.g., punching a copper plate into a predetermined shape, and carries the movable contacts 26 respectively on first surfaces (lower surfaces in FIG. 6) of movable spring portions 60 formed at longitudinal opposite ends of the plate spring. The movable contacts 26 constitute make contacts 26a and break contacts 26b respectively corresponding to the make contacts 28*a* and the break contacts 28b of the fixed contacts 28 provided on the upper plate member 30 of the base 12 (FIG. 7). Each movable spring portion 60 is formed into a bifurcate shape, so as to obtain a desired contact pressure at the instant when the contacts are closed. Each conductive plate spring 24 is substantially embedded in the insulating member 54 in an intermediate portion between the movable spring portions 60 at the opposite ends. Consequently, the conductive plate springs 24 are arranged symmetrically with respect to the center line 22*c* linking the abutting surfaces 20 of the armature 22 and disposed side-by-side to be laterally separated from the armature 22.

A hinge spring portion 62 is integrally joined to each conductive plate spring 24 at the center of the intermediate portion thereof, so as to extend laterally from the insulating member 54 along the pivoting center 22*a* of the armature 22. Each hinge spring portion 62 extends in U-shape toward the make contact 26*a* in relation to the pivoting center 22*a*, and terminates on the side of the break contact 26*b*. The hinge spring portion is fixed at a distal end 62*a* thereof to the common contact 38 provided on the upper plate member 30 of the base 12 by, e.g., a welding process.

In this way, the armature 22 and the two conductive plate springs 24, integrated through the insulating member 54, are combined with the base 12 having the assembled structure and containing the electromagnet 14 as described above, by mounting the pair of seats 58 formed on the bottom surface 54*a*of the insulating member 54 on the pair of supports 36 protruding on the upper plate member 30 of the base 12, and by fixing the distal ends 62*a* of the hinge spring portions 62 of the conductive plate springs 24 to the two common contacts 38 provided on the upper plate member 30. In this arrangement, the movable contacts 26 formed at the opposite ends of each conductive plate spring 24 are disposed opposite to the corresponding fixed contacts 28 provided on the upper plate member 30 of the base 12. Then, under the interaction of the magnetic flux of the electromagnet 14 and the magnetic flux of the permanent magnet 16, the armature 22 and the two conductive plate springs 24 pivot or rotate integrally, so as to selectively open or close the make contacts 26*a*, 28*a* and the break contacts 26*b*, 28*b* according to the rotation. In this respect, the conductive plate springs 24 act to selectively conduct the corresponding make fixed contact 28*a* or break fixed contact 28*b* to the common contact 30, and to bias the armature 22 and the conductive plate springs 24 toward a break side by the respective hinge spring portions 62. A relay assembly thus assembled in this way is then put into an outer casing 64 as shown in FIG. 1, and a gap formed in the underside of the casing 64 is sealed, so that the polar relay 10 is completed.

The polar relay 10 according to the present invention has essentially a characteristic construction for assuring sufficient dimensions for insulation, i.e., sufficient insulating distances, meeting the requirements of IEC60950, as described before, when it is mounted in an information processing apparatus adapted to be connected to a telecommunications channel, such as a modem or a facsimile.

Section 2.10.3.2 of IEC60950 (1999) prescribes that dimensions for insulation, required between circuits, should be assured to be 1 mm and more for a commercial alternating supply voltage of 150 V or less, while to be 2 mm and more for a commercial alternating supply voltage of over 150 V and not greater than 300 V. In order to meet these requirements, the polar relay 10 is constructed in such a manner that a maximum distance between the movable contact 26 and the fixed contact 28, capable of coming into contact with each other, (i.e., an open-contact distance) is 1 mm and more during the travel of the armature 22. Conventionally, in a small size, low power-consumption type polar relay having a balanced-armature structure, an open-contact distance has been held in the order of 0.3 mm to 0.5 mm. On the other hand, the polar relay 10 according to the present invention is capable of assuring the open-contact distance of 1 mm and more while maintaining the small size/low power-consumption properties thereof, by adopting various characteristic constructions as described below.

Figure 8A:
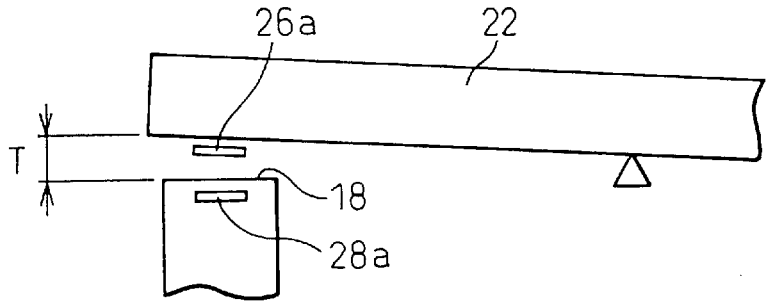
FIG. 8A is a schematic front view showing the position of an armature when contacts are opened, in a conventional polar relay.
Figure 8B:
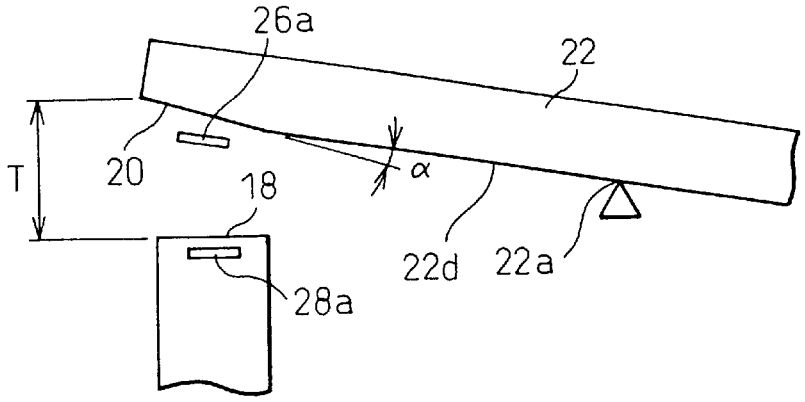
FIG. 8B is a schematic front view showing the position of an armature when contacts are opened, in the polar relay of FIG. 1.

First, in order to increase the insulation distances, required between opened or broken contacts, the polar relay 10 has features wherein the travel (i.e., the pivoting angle) of the armature 22 is increased in comparison with a conventional polar relay, while the thickness (i.e., the dimension in a pivoting direction) of opposite end regions of the plate-like armature 22 is gradually decreased toward the longitudinal ends of the armature 22, so that both of the pair of abutting surfaces 20 of the armature 22 are formed as inclined surfaces with respect to a major plane 22*d* (FIG. 8B). On the other hand, the pair of core polar surfaces 18 of the electromagnet 14 have a shape as punched from a magnetic steel plate, and therefore are formed as horizontal faces substantially parallel with the major plane 22*d* of the armature 22 located in a balanced position. As will be described later, the abutting surface 20 as the inclined surface is formed so as to reduce the angle between opposed surfaces at the time of being mutually abutted to or contact with the core polar surface 18, as much as possible.

Figure 8C:
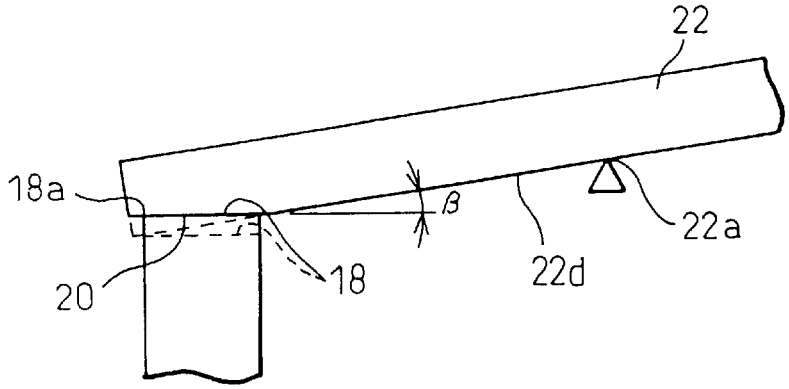
FIG. 8C is a schematic front view showing the position of an armature when contacts are closed, in the polar relay of FIG. 1.

As shown schematically in FIGS. 8A to 8C, as a result of increasing of the travel T of the armature 22, for example, a spatial distance between the make movable contact 26*a* and the make fixed contact 28*a* is increased in comparison with a conventional polar relay (FIG. 8A) when the armature 22 is not operated (i.e., the break contacts are closed), so that sufficient insulation distances can be assured (FIG. 8B). Although not shown, spatial distance between the break movable contact 26*b* and the break fixed contact 28*b*, when the armature 22 is operated (i.e., the make contacts are closed), is also increased in a similar way. In this respect, as shown in FIG. BC, each abutting surface 20 of the armature 22 is formed as the inclined surface for reducing the angle between opposed surfaces at the time of being mutually abutted to the core polar surface 18 as much as possible, so that the dimension of a gap defined between the abutting surface 20 and the core polar surface 18, at the time when the make movable contact 26*a* and the make fixed contact 28*a* are closed, is reduced as much as possible. As a result, although the travel T of the armature 22 is increased, a magnetic resistance, at the time when the make contacts are closed, is reduced, and a magnetic attractive force is thereby prevented from decreasing. Also, in this construction, the thickness of the opposite end regions of the armature 22 is gradually reduced, so that the decrease of a magnetic attractive force generated by the electromagnet 14 for operating the armature 22 is kept to a minimum.

Further, the armature 22 is constructed such that the relation a $\alpha \leqq \beta$ holds, where a is the inclination angle of each abutting surface 20 with respect to the major plane 22*d* of the armature 22 (FIG. 8B) and $\beta$ is the angle between the major plane 22*d* of the armature 22 and each core polar surface 18 at the time of being mutually abutted (FIG. 8C). With this dimensional relationship, the armature 22 always passes, during the pivoting motion thereof, a position where each of the abutting surfaces 20 oppositely faces the corresponding core polar surface 18 in parallel with each other. Since the position where the abutting surface 20 oppositely faces the core polar surface 18 in parallel with each other is the most efficient position at which the magnetic attractive force is exerted uniformly over the entire abutting surface 20, it is ensured, by realizing the above abutment relationship, that the armature 22 always passes this most efficient position and thereby operates stably.

Figure 9A:
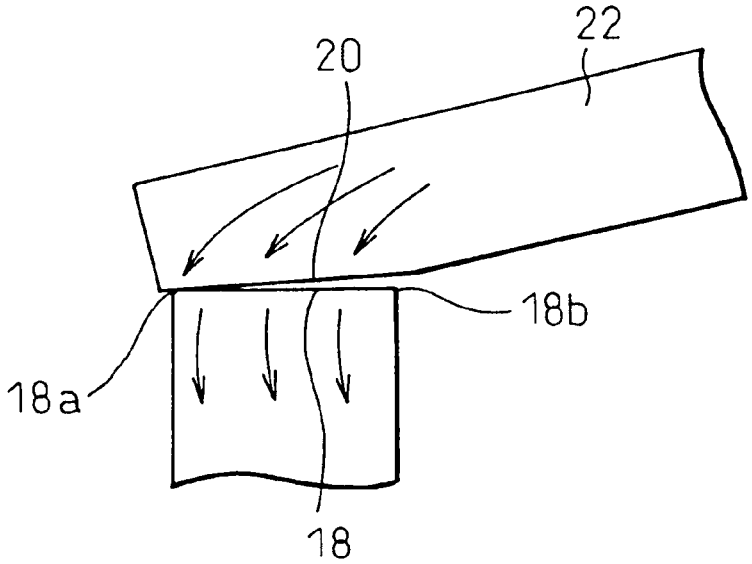
FIG. 9A is an enlarged view showing a configuration of a mutual abutment between the armature shown in FIG. 8C and a core.
Figure 9B:
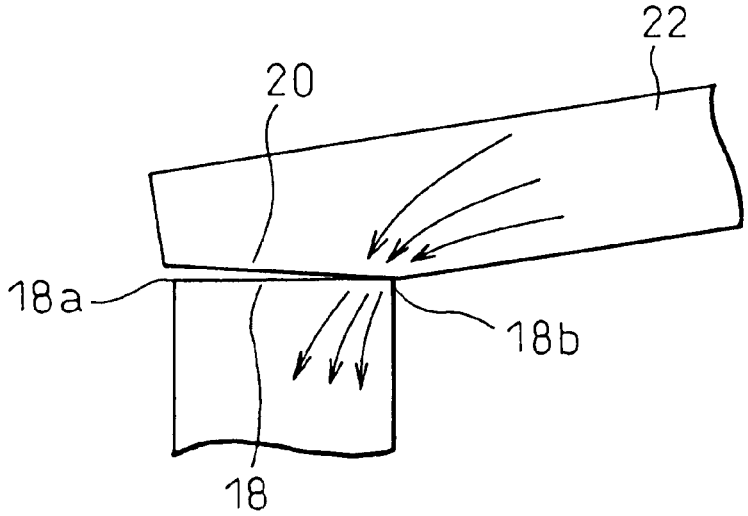
FIG. 9B is an enlarged view showing an undesirable configuration of a mutual abutment between an armature and a core.

Also with this construction, when the armature 22 comes into abutment to or contact with the core polar surface 18, the abutting surface 20 is abutted, as shown in FIG. 9A, at least to the outer corner portion 18*a* of the core polar surface 18 in relation to the pivoting center 22*a*. As a result, during the time when the abutting surface 20 of the armature 22 is abutted to the core polar surface 18, a magnetic flux reaches a region near the end of the armature 22, so that it is also possible to efficiently generate a magnetic attractive force over the entire abutting surface 20. On the contrary, in the case where the abutting surface 20 comes into abutment, as shown in FIG. 9B, with the inner corner portion 18*b* of the core polar surface 18, a magnetic flux does not reach the end region of the armature 22, so that it is difficult to generate a magnetic attractive force efficiently over the entire abutting surface 20.

Further, in the above construction, since the abutting surface 20 of the armature is formed as the inclined surface, it is possible to bring the position of the corresponding core polar surface 18 closer to the abutting surface 20 as compared to the case where the abutting surface is formed in parallel with the major plane 22*d* (shown by a broken line in FIG. 8C). As a result, it is possible to keep the increase of the overall height of the finished product of the polar relay 10 due to the enlargement of the travel T of the armature 22 to a minimum.

The abutting surface 20 of the armature 22 can be formed by, e.g., a pressing process, as the inclined surface having the desired angle a. Also, instead of, or in addition to, forming the abutting surface 20 as the inclined surface, the core polar surface 18 of the electromagnet 14 may post-machined to be formed as an inclined surface that is inclined with respect to the major plane 22*d* of the armature 22 located in the balanced position. In this case, the structure is also advantageous in that the angle between opposed surfaces at the time when the abutting surface contacts with the core polar surface is reduced as much as possible, and in that the armature 22 passes, during the pivoting motion thereof, a position where the abutting surface 20 oppositely faces the corresponding core polar surface 18 in parallel with each other.

Figure 10:
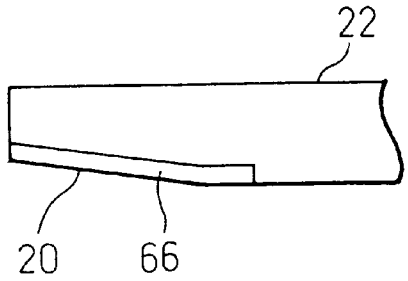
FIG. 10 is an enlarged view showing the end region of the armature of FIG. 6.

Incidentally, when the polar relay 10 is to be constructed as a self-reset relay capable of automatically shifting, at the time of non-excitation of the electromagnet 14, from a make-contacts closing state to a break-contacts closing state, it is necessary to construct it in such a manner that a magnetic attractive force exerted by the permanent magnet 16 between the core polar surfaces 18 of the electromagnet 14 and the abutting surfaces 20 of the armature 22 during the time when a magnetomotive force is 0 A, is smaller in the make side than in the break side. For this purpose, it is advantageous, as shown in FIG. 10, to form a non-magnetic layer 66 on the abutting surface 20 in the make side of the armature 22. The non-magnetic layer 66 can be formed by, e.g., welding non-magnetic material such as copper or stainless steel onto the surface of the armature 22.

In the above construction, in order to accurately adjust the magnetic attractive force on the make side, it is desirable to form the non-magnetic layer 66 with a uniform thickness over the entire abutting surface 20 of the armature 22. However, if the abutting surface 20 of the armature 22 is formed into the inclined surface by a pressing process as described above after forming the non-magnetic layer 66 on the abutting surface 20, the thickness of the non-magnetic layer 66 would also become gradually thinner toward the longitudinal end of the armature 22. Alternatively, if the non-magnetic layer 66 is post-processed to be welded onto the abutting surface 20 as the inclined surface, welding failure would tend to occur, which makes stable forming difficult.

Figure 11A:
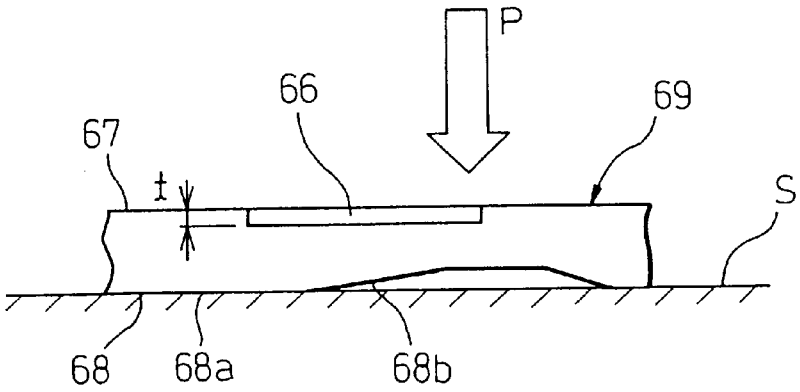
FIG. 11A is a schematic front view illustrating a stage before pressing, in a process for manufacturing the armature of FIG. 9A.

Thus, in the polar relay 10, the armature 22 is manufactured by the following characteristic method. First, as shown in FIG. 11A, a magnetic plate 69 is provided, which includes a first flat surface 67 and a second surface 68 consisting of a major flat-face portion 68*a* parallel with the first surface 67 and an inclined-face portion 68*b* crossing at an obtuse angle with the major portion 68*a* and extending in a direction gradually approaching the first surface 67. The inclined-face portion 68*b* of the magnetic plate 69 is previously provided with a construction (dimensions, shape, angle, etc.) to coincide with that of the abutting surface 20 of the armature 22 to be manufactured. Then, the non-magnetic layer 66 with a uniform thickness t is formed in a region of the first surface 67 of the magnetic plate 69 situated on the opposite side of the inclined-face portion 68*b*.

Figure 11B:
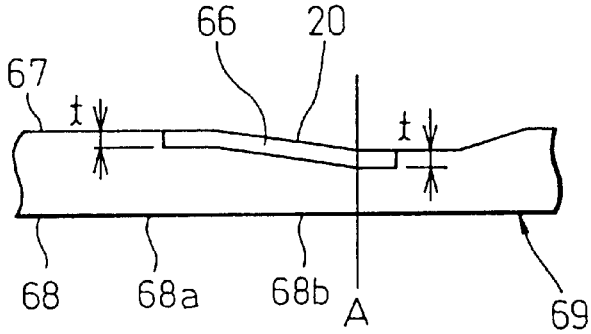
FIG. 11B is a schematic front view illustrating a stage after pressing, in the process for manufacturing the armature of FIG. 9A.

Then, the second surface 68 of the magnetic plate 69 is oriented to be opposed to a flat supporting surface S and the magnetic plate 69 is fixedly placed on the supporting plane S. In this condition, the region containing the non-magnetic layer 66 in the first surface is pressed with a pressure P. Thereafter, the magnetic plate 69 is deformed until a desired surface region of the non-magnetic layer 66 takes the mirror image shape of the inclined-face portion 68*b* formed on the second surface 68, and, as a result, the inclined-face portion 68*b* shifts into a plane common to the major flat-face portion 68*a*. During this process, the pressed region of the magnetic plate 69 displaces the material thereof without changing its own thickness, so that the thickness t of the non-magnetic layer 66 is also maintained in an entirely uniform condition. In this way, an inclined face, having the non-magnetic layer 66 with a uniform thickness, is formed on the first surface 67 of the magnetic plate 69 (FIG. 11B). Since the shape of the inclined face having the non-magnetic layer 66 coincides with the shape of the abutting surface 20 of the armature 22, the armature 22 including the inclined abutting surface 20 having non-magnetic layer 66 with an entirely uniform thickness is manufactured by cutting off the excess portion of the magnetic plate 69 along a solid line A.

Figure 12:
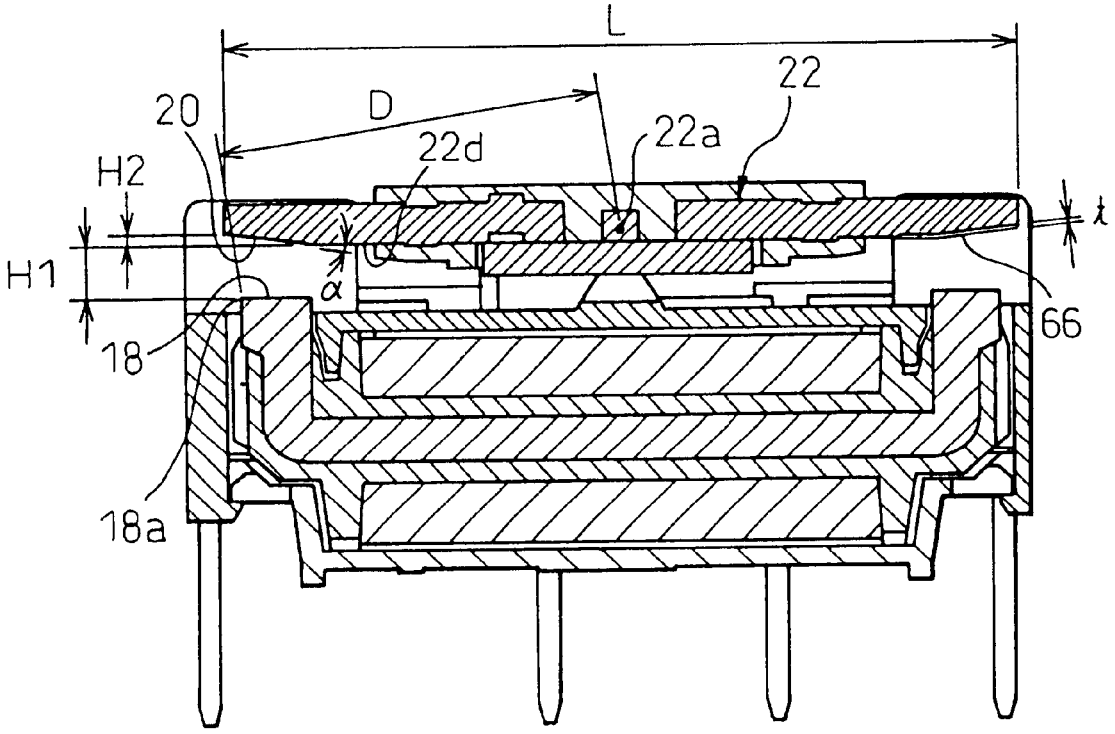
FIG. 12 is a sectional view showing the overall construction of the polar relay of FIG. 1.

Now, the approximate dimensions of various components in the specific embodiment of the construction described above will be enumerated below. Referring to FIG. 12, the above construction is realized, wherein the longitudinal overall length L of the armature 22 is 17.8 mm (L=17.8 mm), the distance D between the pivoting center 22*a* of the armature 22 and the outer corner portion 18*a* of the core polar surface 18 is 8.6 mm (D=8.6 mm), the difference in height H1 between the core polar surface 18 and the pivoting center 22*a* is 1.27 mm (H1=1.27 mm), the difference in height H2, at a position 8.6 mm distant from the pivoting center 22*a*, between the abutting surface 20 and the major plane 22*d* is 0.2 mm (H2=0.2 mm), the thickness t of the nonmagnetic layer 66 in the abutting surface 20 in the make side is 1.0 mm (t=1.0 mm), and the inclination angle $\alpha$ of each abutting surface 20 is approximately 7.7° ($\alpha$=approximately 7.7°). In this arrangement, the armature 22 pivots over an angle of approximately 9.9° about the pivoting center 22*a*, and each abutting surface 20 comes into abutment with the outer corner portion 18*a* of the corresponding core polar surface 18.

Figure 13:
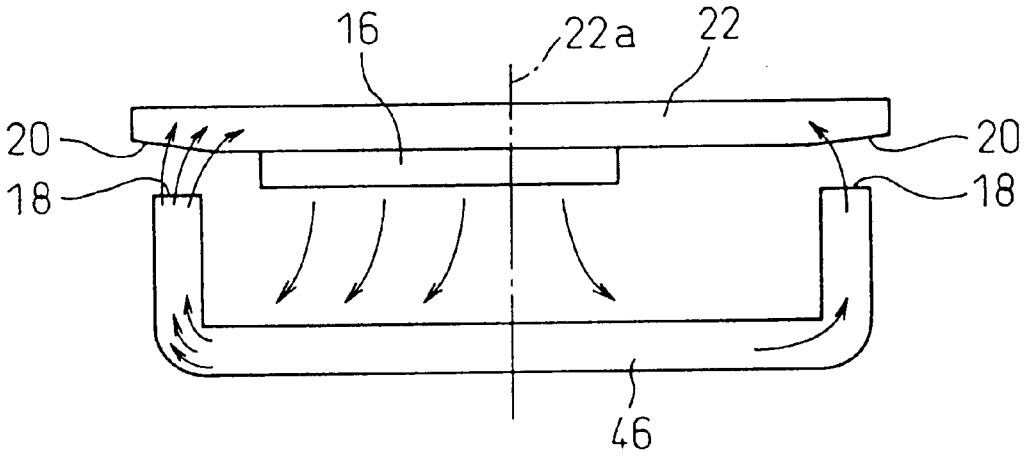
FIG. 13 is a schematic view showing a modification of a magnetic circuit in the polar relay of FIG. 1.
Figure 14:
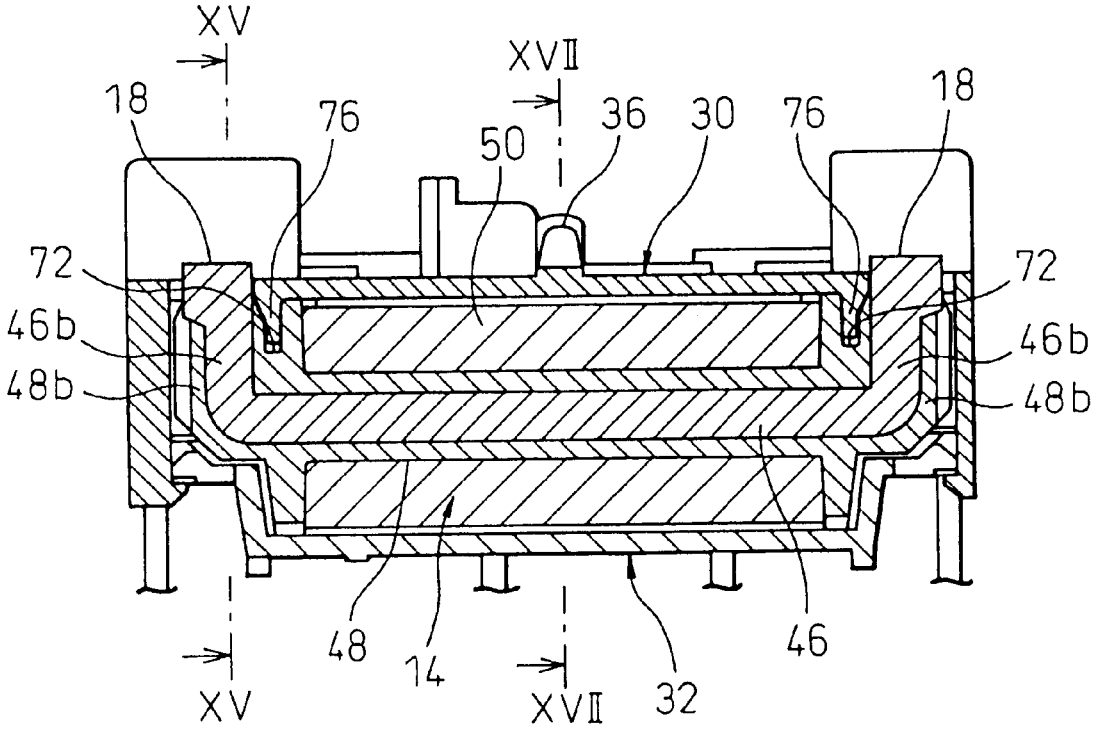
FIG. 14 is a sectional view, taken along a line XIV—XIV in FIG. 15, showing an assembly of the base and the electromagnet in the polar relay of FIG. 1.

As another measure for constructing the polar relay 10 as a self-reset relay, the permanent magnet 16 fixed to the lower surface of the armature 22 may be disposed at a position deviated toward the break side with respect to the pivoting center 22*a*, as diagrammatically shown in FIG. 13. In this arrangement, a magnetic flux from the permanent magnet 16 is greater at the core polar surface 18 in the break side than at the core polar surface 18 in the make side, so that it is possible to lower the magnetic attractive force in the make side to a level smaller than that in the break side during the time when a magnetomotive force is 0 A. This construction may be adopted in place of, or in addition to, the above-described construction wherein the non-magnetic layer 66 is formed on the abutting surface 20.

Next, in the case of a dual-circuit type polar relay 10, it is required that, between two conductive plate springs 24 disposed side-by-side in respective both sides of the armature 22, sufficient insulation distances are assured between the movable make contacts 26*a* as well as between the movable break contacts 26*b* thereof. However, when the travel of the armature 22 is increased in order to increase the insulation distances required between the opened contacts as already described, it is necessary to provide a relatively thin and long meandering shape (FIG. 7), capable of generating a desired spring force, to the hinge spring 62 for biasing the armature 22 toward the break side. If the insulation distances are to be assured, in this construction, between the corresponding contacts arranged side-by-side in two conductive plate springs 24 against, especially, the short-circuit through the armature 22, the spatial distance between the armature 22 and each conductive plate spring 24 is increased. Thus, due to the shapes of the hinge springs 62 projecting laterally in both sides of the armature 22, there is a fear of an increase in the overall dimension in the lateral direction of the polar relay 10.

Therefore, the polar relay 10 is constructed in such a manner that, as shown in FIG. 7, the insulating member 54 integrating the armature 22 and two conductive plate springs 24 includes a pair of extensions 70 extending toward the longitudinal opposite end regions of the armature 22 so as to cover most of the intermediate region of the armature 22. These extensions 70 integrally extend from the longitudinal opposite end surfaces 54*b* of the insulating member 54, from which the longitudinal opposite end regions of each conductive plate spring 24 project, along the intermediate portion 22*b* of the armature 22, and act so as to increase the insulation distances, as a creepage distance, required between the longitudinal end regions of the armature 22 and the longitudinal end regions of each conductive plate spring 24, both exposed outside the insulating member 54. Thus, as shown in the drawing, each conductive plate spring 24 can be formed in a shape such that it gradually approaches the extensions 70 of the insulating member 54 at a length within the range from the movable spring portion 60 at the opposite ends to the end surfaces 54*b* of the insulating member 54. That is, each conductive plate spring 24 is disposed so as to have a lateral space between the proximal end portions 24*a* projecting from the end surfaces 54*b* of the insulating member 54 and the extensions 70 of the insulating member 54 smaller than a lateral space between the movable contacts 26 and the abutting surfaces 20 of the armature 22. In this arrangement, sufficient insulation distances required between the exposed portion of each conductive plate spring 24 and the exposed portion of the armature 22, is also assured as a spatial distance (or a clearance) and as a creepage distance.

According to this construction, even when two conductive plate springs 24 have such configurations that the space between the intermediate portions thereof is less than the space between the movable spring portions 60 as shown in the drawing, it is possible to assure sufficient insulation distances, required against a short-circuit, between the contacts of the conductive plate springs 24 and especially through the armature 22. In this respect, although the hinge spring 62 projecting from the longitudinal center of each conductive plate spring 24 to a lateral side of the armature 22 has a relatively thin and long meandering shape, it is possible to suppress the increase of the whole lateral dimension of the finished product of the polar relay 10 because of the narrower space between the intermediate portions of the conductive plate springs 24.

The above arrangement is especially advantageous in the construction wherein the armature 22 has the inclined abutting surfaces 20 as already described. In this construction, the thickness (the dimension in a pivoting direction) of the intermediate region 22*b* of the armature 22, embedded in the insulating member 54, is larger than the thickness of the opposite end regions including the abutting surfaces 20, so that it is possible to define the dimension of the armature 22 in the lateral direction perpendicular to the pivoting direction in such a manner that the intermediate region 22*b* is smaller than the opposite end regions, as long as the magnetic flux density through the armature 22 is not affected. Therefore, it is possible to significantly reduce the space between the intermediate portions of two conductive plate springs 24 in comparison with the space between the movable spring portions 60, which contributes to a size reduction of the polar relay 10.

Next, in order to assure insulation distances required between contacts and a coil, the polar relay 10 adopts a construction capable of assuring sufficient insulation distances required against not only an indirect short-circuit between the contacts 26, 28 and the coil 50 via the core 46 of the electromagnet 14 and the armature 22 but also a direct short-circuit between the contacts 26, 28 and the coil 50. First, for the indirect short-circuit, combined portions are provided to the upper plate member 30 of the base 12 interposed between the armature 22 and the coil 50 of the electromagnet 14 as well as to the bobbin 48 of the electromagnet 14, so as to be complementarily combined with each other at a position between a pair of core polar surfaces 18 of the core 46 and the coil 50. Thereby, the upper plate member 30 and the bobbin 48 cooperate with each other to increase the insulation distances required between the core polar surfaces 18 and the coil 50.

More specifically, as shown in FIGS. 4, 5, 14 and 15, a groove 72 is formed on the bobbin 48 of the electromagnet 14 to extend in the lateral direction of the electromagnet 14, at a location between each end portion 48*b* covering most of each arm portion 46*b* of the core 46 and each flange portion 48*c* provided in the interconnection of the intermediate portion 48*a* with each end portion 48*b* . Also, grooves 74 are formed on each end portion 48*b* to communicate with the groove 72, at locations in the respective lateral sides of the arm portion 46*b* of the core 46. On the other hand, plate walls 76, 78 are formed on the upper plate member 30 of the base 12 to project toward the inner space between the upper plate member 30 and the bottom plate member 32, at positions respectively corresponding to the grooves 72, 74 of the bobbin 48, and having shapes and dimensions allowing insertion into the grooves 72, 74. Thus, when the upper plate member 30 is combined with the bottom plate member 32 while containing the electromagnet 14 within the inner space thereof as already described, the plate walls 76, 78 of the upper plate member 30 are respectively received in and complementarily combined with the corresponding grooves 72, 74 of the bobbin 48, thereby enclosing the exposed parts of the respective arm portions 46b of the core 46 from three sides. According to this complementary combination structure, it is possible to assure a sufficient creepage distance between the core polar surfaces 18 and the coil 50 without substantially increasing the external dimensions of the polar relay 10.

In connection with the above construction, overhangs 80 are formed on the core 46 of the electromagnet 14 to slightly project outward from the surfaces of both end portions 48*b* of the bobbin 48, at locations near the core polar surfaces 18 at the ends of a pair of arm portions 46*b* (FIG. 4). These overhangs can be effectively used, in the molding process of the bobbin 48 with the core 46 being placed as an insert, as supporting sections for positioning and supporting the core 46 at a predetermined position in a mold (not shown). According to this construction, the bobbin 48 is molded so as to cover substantially entirely the core 46, except for a pair of core polar surfaces 18 and regions surrounding the core polar surfaces 18 including the overhangs 80. As a result, it is possible to surely insulate the core 46 from the coil 50, merely by adopting the above construction for increasing the insulation distances required between the core polar surfaces 18 and the coil 50.

Figure 16:
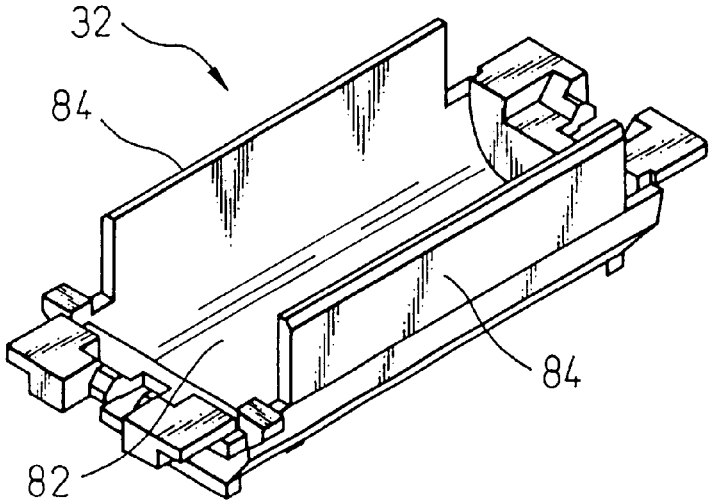
FIG. 16 is an enlarged perspective view showing a bottom plate member of the base in the polar relay of FIG. 1.
Figure 17:
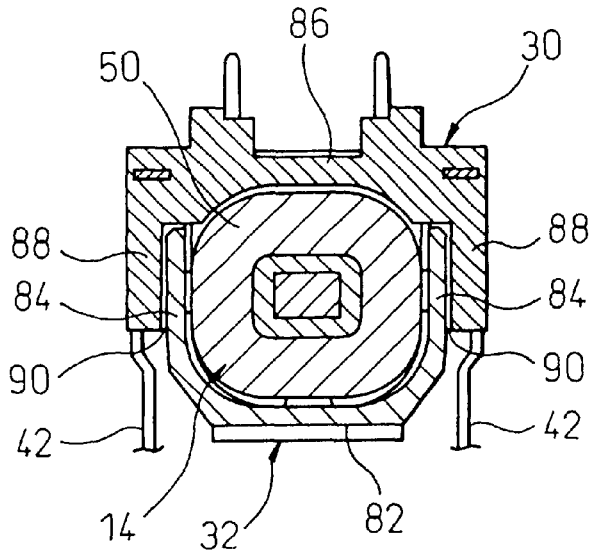
FIG. 17 is a sectional view showing the assembly of FIG. 14, taken along a line XVII—XVII therein.

For the direct short-circuit between the contacts and the coil, combined portions are provided to the upper plate member 30 as well as to the bottom plate member 32 of the base 12, so as to be complementarily combined with each other at positions between a plurality of terminals 40, 42, 44 built into the upper plate member 30 and the coil 50 of the electromagnet 14. Thereby, the upper plate member 30 and the bottom plate member 32 cooperate with each other to increase the insulation distances required between the terminals 40, 42, 44 having respectively the fixed contacts 28 and the common contacts 38 and the coil 50. More specifically, as shown in FIGS. 16 and 17, the bottom plate member 32 of the base 12 is provided with a bottom plate 82 covering the lower surface of the coil 50 and a pair of side plates 84 extending integrally upward from the both side edges extending in the longitudinal direction of the bottom plate 82 to cover the opposite sides of the coil 50. On the other hand, the upper plate member 30 of the base 12 is provided with an upper plate 86 covering the upper surface of the coil 50 and a pair of side plates 88 extending integrally downward from the both side edges extending in the longitudinal direction of the upper plate 86 to be disposed via gaps along the both sides of the coil 50. Thus, when the upper plate member 30 is combined with the bottom plate member 32 while containing the electromagnet 14 within the inner space thereof as already described, the side plates 84 of the bottom plate member 32 are respectively received in and combined complementarily with the gaps between the respective side plates 88 of the upper plate member 30 and the coil 50, and thereby covering entirely the opposite sides of the coil 50. According to this complementary combination structure, it is possible to assure a sufficient creeping distance between the plural terminals 40, 42, 44 and the coil 50 without substantially increasing the external dimensions of the polar relay 10.

Figure 18:
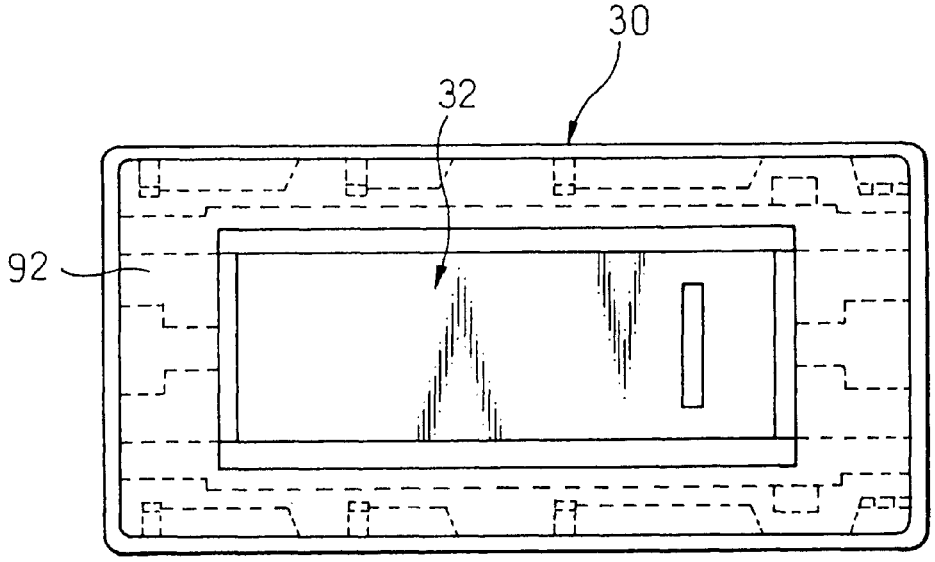
FIG. 18 is a bottom plan view showing the assembly of FIG. 14.

In connection with the above construction, a sealant 92 may be applied to the complementarily combined portions of the upper plate member 30 and the bottom plate member 32, for sealing gaps (as denoted by, e.g., a numeral 90 in FIG. 17) formed in the combined portions (see FIG. 18). The sealant 92 is made of, e.g., an epoxy-base adhesive, and seals the gaps exposed on the external surface of the polar relay 10 as a finished product, whereby serving to increase the dielectric strength of the complementarily combined portions and to improve the air-tightness of the polar relay 10.

Figure 2:
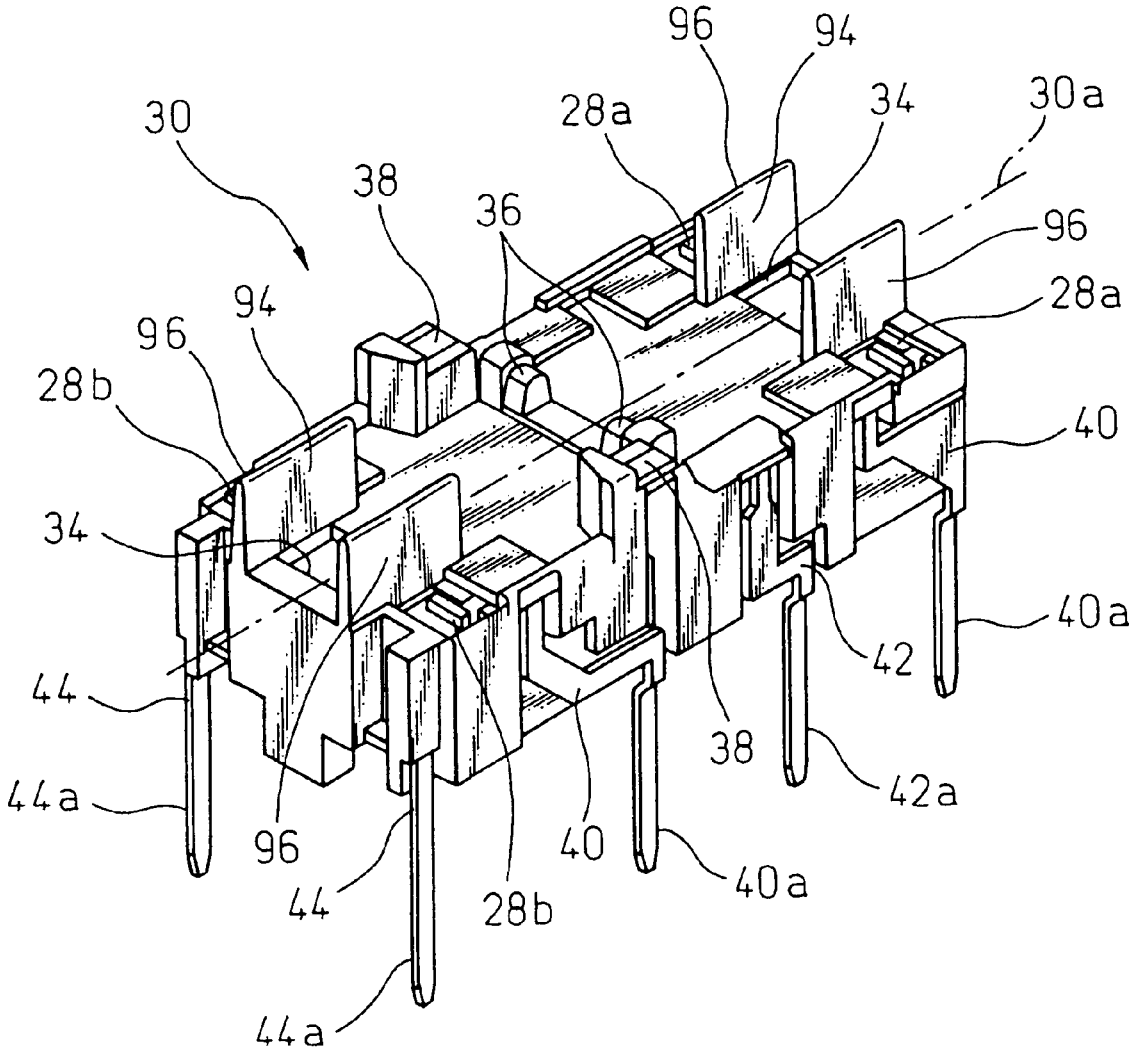
FIG. 2 is an enlarged perspective view showing an upper plate member of a base in the polar relay of FIG. 1.
Figure 15:
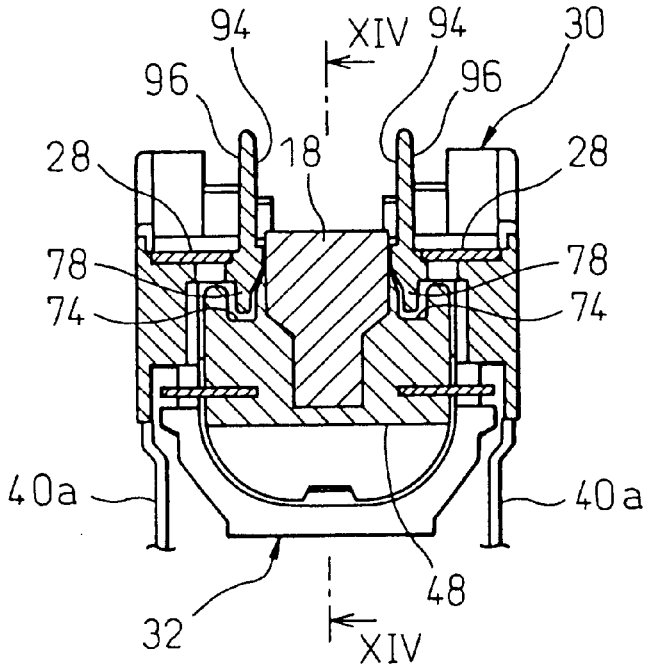
FIG. 15 is a sectional view showing the assembly of FIG. 14, taken along a line XV—XV therein.

Further, in the polar relay 10, as a counter measure against an indirect contact/coil short-circuit, insulating surface zones 94 are provided between the pair of core polar surfaces 18 of the electromagnet 14, exposed on the upper surface of the upper plate member 30 of the base 12, and the plural fixed contacts 28, so as not to be exposed to each of the fixed contacts 28. In the illustrated embodiment, as shown in FIGS. 2 and 15, a pair of walls 96 projecting upward from the upper surface of the upper plate member 30 are formed respectively between each of the pair of openings 34 of the upper plate member 30 and two fixed contacts 28 neighboring them, and the mutually opposed surfaces of the walls 96 constitute the insulating surface zones 94.

Figure 19A:
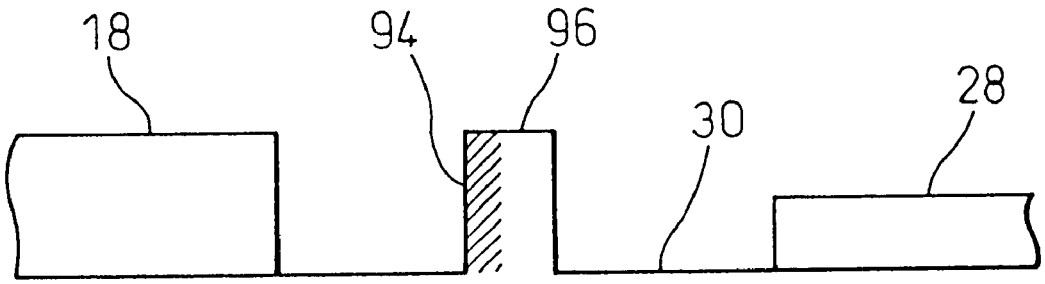
FIG. 19A is a schematic view showing an indirect insulating-wall structure between the contact and the coil in the polar relay of FIG. 1.
Figure 19B:
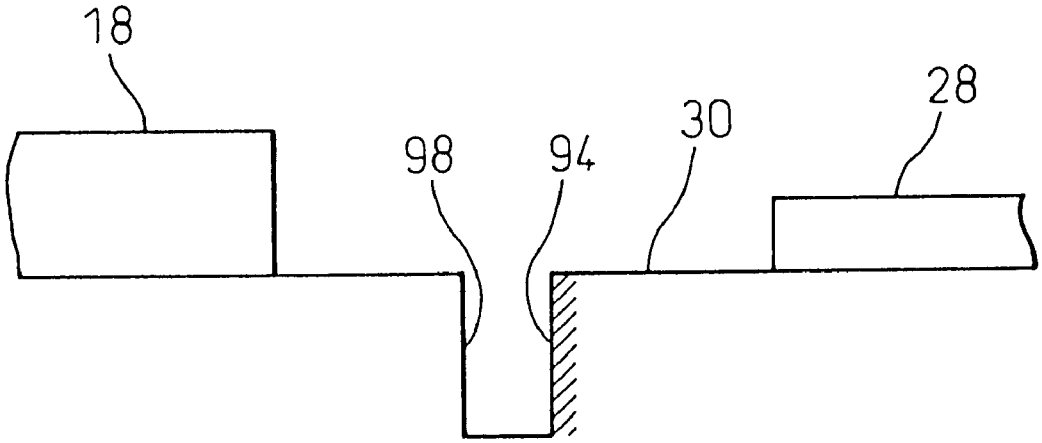
FIG. 19B is a schematic view showing an indirect insulating-groove structure between the contact and the coil in the polar relay of FIG. 1.

As diagrammatically shown in FIG. 19A, the insulating surface zone 94 formed by the wall 96 is located at a position where it is not easily affected by scattered metal particles due to the abrasion of the fixed contacts 28 or material carbonization due to arc discharges. Therefore, the insulating surface zone 94 serves to reinforce the function of the wall 96 increasing the creeping distance between the core polar surface 18 and the fixed contact 28, and to prevent the deterioration of dielectric strength between the core and the contacts. In this respect, as shown in FIG. 19B, a similar operative effect can be obtained by providing a groove 98 in the upper plate member 30, instead of the walls 96, to be recessed at a location between the core polar surface 18 and the fixed contact 28, so as to form an insulating surface zone 94 inside the groove 98.

As will be appreciated from the above description, according to the present invention, it becomes possible, in a polar relay of a balanced-armature type, to surely establish sufficient insulation distances required between opened or broken contacts as well as sufficient insulation distances required between contacts and a coil, without increasing external dimensions of the finished product. Further, in a double-circuit polar relay of a balanced-armature type, it becomes possible to surely establish sufficient insulation distances required between contacts arranged side-by-side, without increasing external dimensions of the finished product. Therefore, the polar relay according to the present invention is capable of assuring, by its own structure, sufficient insulation distances meeting the requirements of IEC60950, when it is mounted in an information processing apparatus adapted to be connected to a telecommunications channel.

Figure 20:
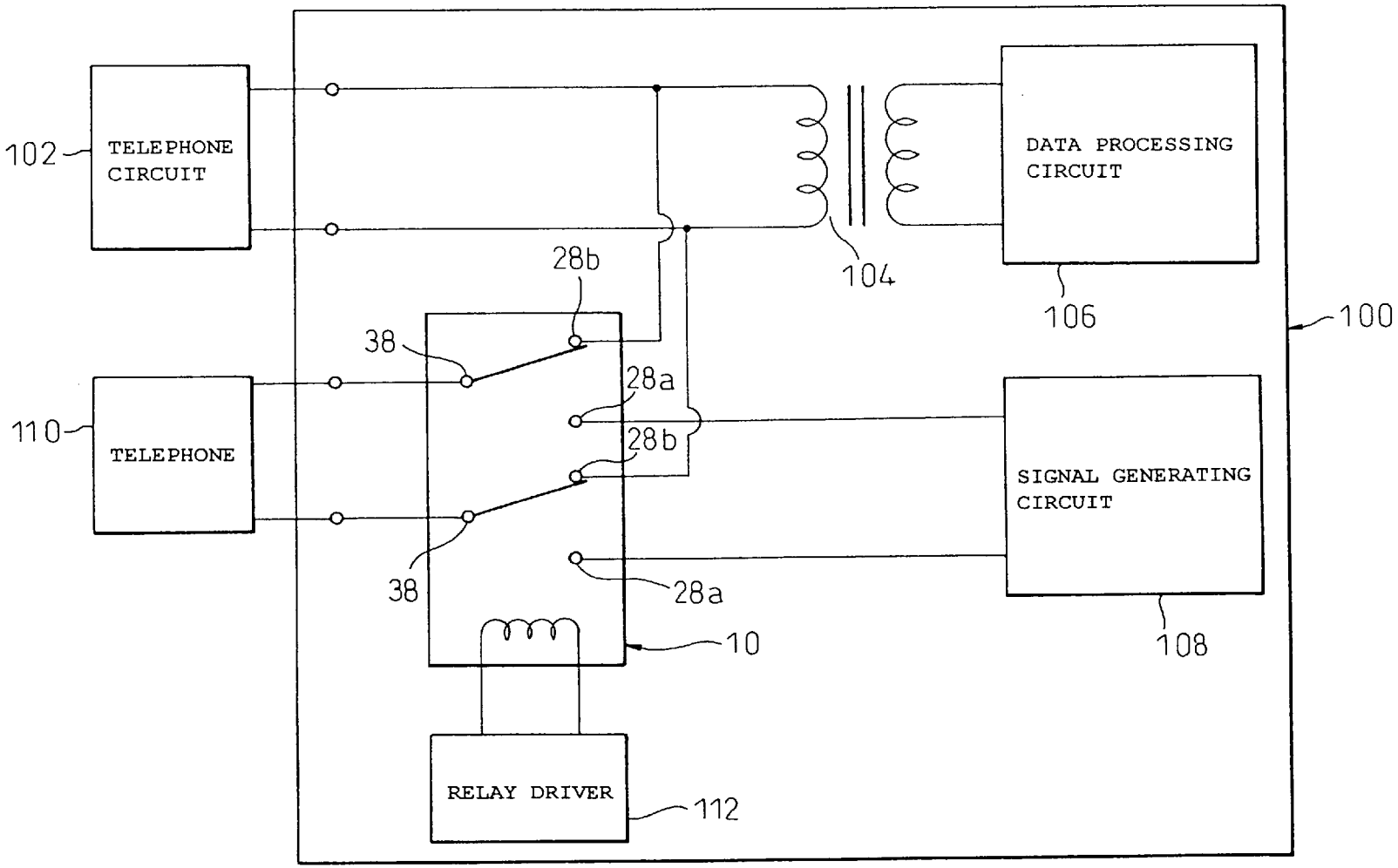
FIG. 20 is a schematic circuit diagram showing the construction of an information processing apparatus according to an embodiment of the present invention.

FIG. 20 is a schematic circuit diagram showing the construction of an information processing apparatus 100 including the polar relay 10, according to an embodiment of the present invention. The information processing apparatus 100 has the construction of a data processing section of a facsimile incorporating a telephone function therein, and includes a data processing circuit 106 electrically connected via an isolating transformer 104 to a telephone circuit 102 as one example of a telecommunications channel, and a signal generating circuit 108 insulated from the telephone circuit 102 by the polar relay 10. The polar relay 10 is arranged so that the make contacts 28*a* are connected to the signal generating circuit 108, the break contacts 28*b* are connected to the telephone circuit 102, and the common contacts 38 are connected to a telephone 110.

The information processing apparatus 100 usually transmits or receives a facsimile signal between the data processing circuit 106 and the telephone circuit 102. For example, when a facsimile signal is received from the telephone circuit 102, the data processing circuit 106 performs a facsimile reception process without ringing the bell of the telephone 110. The telephone 110 is usually connected to the telephone circuit 102 through the polar relay 10, so as to permit speech transmission from the telephone 110. In this arrangement, when a telephone signal is received from the telephone circuit 102, the data processing circuit 106 first recognizes a telephone reception, and, immediately after the recognition, excites a relay driver 112 to operate the polar relay 10, because a bell-starting signal from the telephone circuit 102 terminates in the meantime. Thereby, the connection of the telephone circuit 102 with the telephone 110 is cut off, and the signal generating circuit 108 is connected to the telephone 110 through the polar relay 10, so as to send the bell-starting signal from the signal generating circuit 108 to the telephone 110. Immediately after the telephone 110 becomes ready for receiving, the data processing circuit 106 resets the polar relay 10 by the relay driver 112. Consequently, the telephone 110 is again connected to the telephone circuit 102, and thereby enabling two-way communication.

In the information processing apparatus 100 having the above construction, it is necessary to insulate the telephone circuit 102 from the data processing circuit 106 and the signal generating circuit 108 by the insulation distances prescribed in IEC60950. In this respect, the polar relay 10 assures the open-contact distance of 1 mm and more, capable of meeting the requirements of IEC60950, while maintaining the small size and low power-consumption properties inherent in the balanced-armature type polar relay, as already described. Therefore, in the illustrated con figuration, the polar relay 10 surely insulates the telephone circuit 102 from the signal generating circuit 108 by the insulation distances meeting the requirements of IEC60950. Consequently, it is no longer necessary to interpose an insulating transformer or any other insulating elements between the signal generating circuit 108 and the telephone circuit 102, which facilitates a further reduction in size of the information processing apparatus 100.

Figure 21:
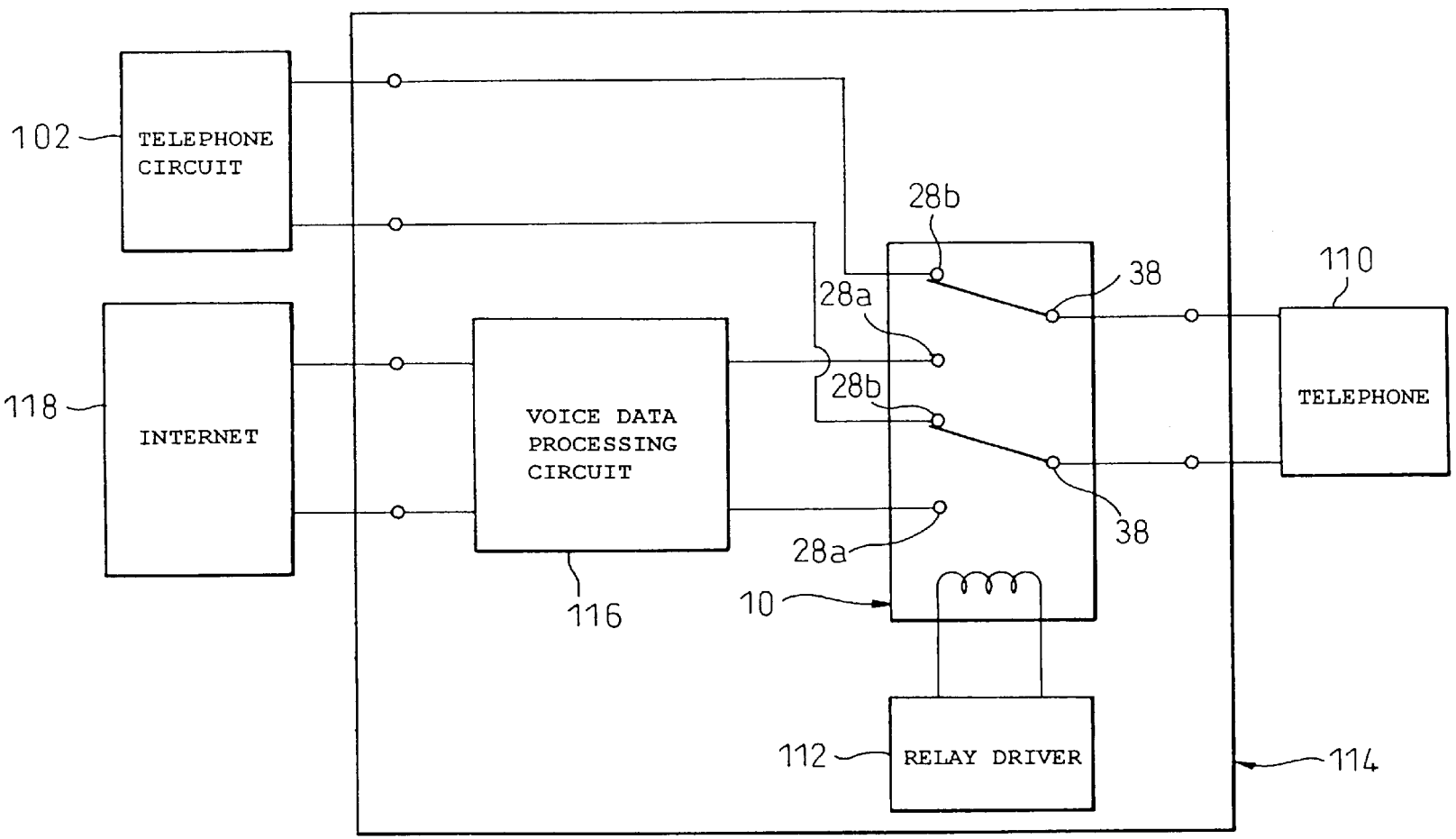
FIG. 21 is a schematic circuit diagram showing the construction of an information processing apparatus according to another embodiment of the present invention.

FIG. 21 is a schematic circuit diagram showing the construction of an information processing apparatus 114 including the polar relay 10, according to another embodiment of the present invention. The information processing apparatus 114 has the construction of a data processing section of a general circuit/Internet convertible telephone, and includes a voice data processing circuit 116 insulated by the polar relay 10 from a telephone circuit 102 as one example of a telecommunications channel. The polar relay 10 is arranged so that the make contacts 28*a* are connected to the voice data processing circuit 116, the break contacts 28*b* are connected to the telephone circuit 102, and the common contacts 38 are connected to a telephone 110. The voice data processing circuit 116 is connected to Internet 118.

The information processing apparatus 114 usually connects the telephone 110 to the telephone circuit 102 through the polar relay 10, and thereby enabling a two-way communication. In this arrangement, when the telephone 110 is used as an internet phone, the relay driver 112 is excited in response to a user's request to operate the polar relay 10. Thereby, the connection between the telephone circuit 102 and the telephone 110 is cut off, and the voice data processing circuit 116 is connected to the telephone 110 through the polar relay 10. Consequently, voice data input to or output from the telephone 110 are suitably processed by the voice data processing circuit 116, so as to be transmitted or received by the Internet 118.

In the information processing apparatus 114 having the above construction, it is necessary to insulate the telephone circuit 102 from the voice data processing circuit 116 by the insulation distances prescribed in IEC60950. In this respect, the polar relay 10 functions similarly in the information processing apparatus 110 as described above, and thus surely isolates the telephone circuit 102 from the voice data processing circuit 116 by the insulation distances meeting the requirements of IEC60950. As a result, it is no longer necessary to interpose an isolating transformer or any other insulating element between the voice data processing circuit 116 and the telephone circuit 102, which facilitates the further reduction in size of the information processing apparatus 114. Please note that the information processing apparatus 114 may be installed into a switching system equipped in a building, instead of a desk-top type general circuit/Internet convertible telephone.

Thus, according to the present invention, a miniature information processing apparatus of a low power-consumption type is provided that is capable of assuring sufficient insulation distances, meeting the requirements of IEC60950, when it is connected to a telecommunications channel.

While certain preferred embodiments according to the present invention have been described above, the present invention is not limited to these embodiments, but various changes and modifications may be made within the scope of the appended claims. For example, in order to meet the requirements of IEC60950, it is desirable that a single polar relay adopts all of the above-described various insulation measures in the polar relay. However, depending upon the application of the polar relay, only desired one of these measures may be adopted, or two or more measures may be adopted in a desired combination. All insulation measures, except for those requiring that the base has a combination structure as presupposition, may be adopted in a polar relay in which an electromagnet is integrally incorporated into a base through an insert molding process. Similarly, all insulation measures except for those requiring that the polar relay has a double-circuit structure as presupposition, may be adopted in a single-circuit type polar relay. Further, the polar relay according to the present invention may be mounted, for the purpose of insulation between the circuits, in various information processing apparatus such as a facsimile having a recorder function, a voice modem, etc., other than the above-described facsimile with a telephone function or a general-circuit/Internet convertible telephone.

What is claimed is:

1. A polar relay comprising:

a base;

an electromagnet incorporated into said base;

a permanent magnet disposed in conjunction with said electromagnet;

an armature pivotably supported on said base and including a pair of abutting surfaces disposed in opposite end regions of the armature each at a respective distance from a an armature pivot, said abutting surfaces being respectively opposed to and abuttable against a pair of core polar surfaces of said electromagnet;

at least one electrical conductive plate spring pivotable on said base along with said armature;

a plurality of movable contacts disposed on opposite ends of each of said at least one electrical conductive plate spring; and a plurality of fixed contacts arranged securely on said base, the fixed contacts being respectively opposed to said movable contacts, to make contact with said movable contacts; and wherein at least one of each of said pair of abutting surfaces of said armature and each of said pair of core polar surfaces of said electromagnet, opposed to said abutting surface, comprises an inclined surface for reducing an angle between opposed surfaces during a mutual abutment, and wherein said armature passes, during travel thereof, a position where each of the pair of abutting surfaces oppositely faces a corresponding one of the pair of core polar surfaces in parallel with each other.

2. The polar relay as set forth in claim 1, wherein a thickness of said opposite end regions in a pivoting direction of said armature gradually decreases toward opposite ends of said armature, said pair of abutting surfaces being thereby formed as said inclined surfaces.

3. The polar relay as set forth in claim 2, wherein one of said abutting surfaces of said armature, sides comprises a non-magnetic layer thereon.

4. A The polar relay as set forth in claim 3, wherein a thickness of said non-magnetic layer is uniform.

5. The polar relay as set forth in claim 1, wherein said permanent magnet is fixedly connected to said armature in a position deviated toward a break side.

6. The polar relay as set forth in claim 1, comprising at least two electrically conductive plate springs, wherein said polar relay further comprises an insulating member integrally connecting said armature with said at least two electrically conductive plate springs so as to be spaced in a lateral direction perpendicular to a pivoting direction of said armature and arranged side-by-side while at least said abutting surfaces and said movable contacts are exposed, wherein said insulating member covers most of an intermediate portion of said armature located between said opposite end regions, and wherein said at least two electrically conductive plate springs are disposed so as to define, at proximal end portions thereof projecting from said insulating member, a lateral distance, from said insulating member, smaller than a lateral distance between said movable contacts and said abutting surfaces.

7. The polar relay as set forth in claim 6, wherein a thickness of said opposite end regions in said pivoting direction of said armature gradually decreases toward opposite ends of said armature, and wherein a dimension of said opposite end regions in a lateral direction of said armature, perpendicular to said pivoting direction, is larger than a dimension of said intermediate region in said lateral direction.

8. The polar relay as set forth in claim 1, wherein said electromagnet includes a core, an insulating bobbin attached to said core with said pair of core polar surfaces exposed, and a coil wound on said insulating bobbin, wherein said base includes an insulating upper plate interposed between said armature and said coil and cooperating with said insulating bobbin to increase dimensions for insulation, required between said pair of core polar surfaces and said coil, and wherein said insulating bobbin and said insulating upper plate include combinable portions to be complementarily combined with each other at a location between said pair of core polar surfaces and said coil.

9. The polar relay as set forth in claim 8, wherein said core includes, near said pair of core polar surfaces, overhang portions projecting from a surface of said insulating bobbin, and wherein said insulating bobbin covers said core except for said pair of core polar surfaces as well as regions including said overhang portions and surrounding said core polar surfaces.

10. The polar relay as set forth in claim 8, wherein said base includes an insulating bottom plate cooperating with said insulating upper plate to increase dimensions for insulation required between a plurality of terminals respectively having said fixed contacts thereon and said coil, and wherein said insulating upper plate and said insulating bottom plate are complementarily combined with each other at a location between said terminals and said coil.

11. The polar relay as set forth in claim 10, wherein a sealant is applied to complementarily combined portions of said insulating upper plate and said insulating bottom plate for sealing any gap between said combined portions.

12. The polar relay as set forth in claim 1, comprising an insulating surface zone between said pair of core polar surfaces of said electromagnet and said plurality of fixed contacts so as not to expose each of said fixed contacts.

13. An information processing apparatus connectable to a telecommunications channel, wherein a polar relay as set forth in claim 1 is arranged between an inner circuit of said information processing apparatus and a telecommunications channel to assure said dimensions for insulation required between circuits.

14. A polar relay as set forth in claim 1, wherein a maximum distance between one of said movable contacts and one of said fixed contacts, capable of coming into contact with each other during a travel of said armature, is set at 1 mm or more.

* * * * *